United States Patent [19]

Sjte,uml/o/ holm et al.

[11] Patent Number: 5,018,948

[45] Date of Patent: May 28, 1991

[54] ROTARY DISPLACEMENT COMPRESSOR WITH ADJUSTABLE OUTLET PORT EDGE

[75] Inventors: Lars Sjte,uml/o/ holm, Sollentuna; Stig Ludin, Värmdö, both of Sweden

[73] Assignee: Svenska Rotor Maskiner AB, Stockholm, Sweden

[21] Appl. No.: 469,457

[22] PCT Filed: Oct. 13, 1988

[86] PCT No.: PCT/SE88/00533

§ 371 Date: Apr. 9, 1990

§ 102(e) Date: Apr. 9, 1990

[87] PCT Pub. No.: WO89/03482

PCT Pub. Date: Apr. 20, 1989

[30] Foreign Application Priority Data

Oct. 15, 1987 [SE] Sweden ..... 8704017

[51] Int. Cl.[5] ..... F04B 49/04; F04B 49/08; F04C 29/08

[52] U.S. Cl. ..... 417/302; 417/310; 418/159; 418/201.2

[58] Field of Search ..... 418/159, 201.2; 417/302, 310, 440

[56] References Cited

U.S. PATENT DOCUMENTS

| | | | |
|---|---|---|---|
| 3,936,239 | 2/1976 | Shaw | 417/315 |
| 4,042,310 | 8/1977 | Schibbye et al. | 417/310 |
| 4,076,461 | 2/1978 | Moody, Jr. et al. | 417/310 |
| 4,457,681 | 7/1984 | Garland | 417/440 |
| 4,516,914 | 5/1985 | Murphy et al. | 417/282 |
| 4,678,406 | 7/1987 | Pillis et al. | 418/310 |
| 4,842,501 | 6/1989 | Schibbye et al. | 418/201.2 |

FOREIGN PATENT DOCUMENTS

| | | |
|---|---|---|
| 127878 | 9/1975 | German Democratic Rep. . |
| 427063 | 6/1979 | Sweden . |
| 439181 | 6/1984 | Sweden . |
| 1418069 | 6/1973 | United Kingdom . |

*Primary Examiner*—John J. Vrablik

*Attorney, Agent, or Firm*—Frishauf, Holtz, Goodman & Woodward

[57] ABSTRACT

The invention relates to a rotary displacement compressor having volume ratio regulation. A connection channel (8,9,10) connects the working space of the compressor to the pressure channel (5). In the channel (8,9,10) there is provided means (13) for sensing the direction of flow through the channel. The direction of flow is an indication of whether there is over or under compression. Signals from the flow direction sensing means (13) affect the position of a movable edge (29) of the outlet port (32) so that this edge (29) will move to a position where the internal compression complies with the outlet pressure. By using the direction of flow as the governing parameter for the volume ratio regulation instead of the pressure difference or the power consumption of the prime mover according to known technique, a more accurate adaption of the volume ratio to the outlet pressure is achieved.

9 Claims, 3 Drawing Sheets

ROTARY DISPLACEMENT COMPRESSOR WITH ADJUSTABLE OUTLET PORT EDGE

BACKGROUND OF THE INVENTION

The present invention relates to a rotary displacement compressor having at least one rotor mounted in a working space formed by a casing surrounding the rotor(s), in which working space a gaseous working fluid is transported and compressed in compression chambers from an inlet port connected to a suction channel to an outlet port connected to a pressure channel, said outlet port having an edge determining the moment when a compression chamber opens towards the outlet port, the position of said edge being adjustable by actuating means governed by sensing means.

The internal compression of a compressor is independent of the pressure in the pressure channel and is for a certain working fluid depending only on the volume ratio of the compressor, i.e. the relation between the volume of a compression chamber at the moment it just has been closed off from the inlet port and the volume of a compression chamber at the moment just before it is opened towards the outlet port. Assuming a constant inlet pressure, a certain volume ratio thus results in a certain pressure in a compression chamber just before it is opened towards the outlet port, the end pressure of the compressor. It is desirable that the internal compression corresponds to the pressure in the pressure channel, so that the pressure in a compression chamber just before it opens towards the outlet equals the pressure in the pressure channel. If these pressures differ from each other, i.e. at over- or undercompression, a rapid flow of gas through the outlet port occurs each time a compression chamber opens towards it, whereby the pressures become equalized. The flow velocity during this short moment is much higher than the flow velocity of the working fluid when it is displaced out through the outlet port by the rotors, and the direction thereof can be to or from the pressure channel depending on if there is over- or undercompression. These flow pulses generate disturbing noise and vibrations, which can damage the connected pipe system. Simultaneously the efficiency of the compressor will decrease. By these reasons there is always an effort to adapt the built-in volume ratio to the pressure in the pressure channel.

In some cases this pressure, however, can vary, which under such condition makes it desirable to correspondingly make it possible to vary the volume ratio. Since long it is therefore known to provide a compressor with devices regulating this, so called $V_i$-regulation. This is accomplished in that the position of the edge of the outlet port, which determines the moment of opening, can be varied in steps or continuously. By this the volume of a compression chamber at the moment of opening can be changed and therewith the volume ratio. In this way it can be achieved that the pressure in said compression chamber roughly equals the pressure in the pressure channel.

Constructively this can be made in many ways, partly depending on which kind of rotary displacement compressor it relates to. On e.g. a rotary screw compressor having two cooperating rotors, a frequently used regulating device consists of an axially movable slide, displaceably mounted in guiding means parallel to the rotors. The slide has a surface facing the working space, which surface forms a part of the barrel wall of the working space and complies with its shape. The end of the slide facing the high pressure end of the compressor is provided with an edge forming an edge of the outlet port. When the position of said edge is changed by displacement of the slide, the moment of opening of a compression chamber towards the outlet port will be changed and with this its volume at that moment.

For adjusting the slide to a correct position, where neither under- nor overcompression prevails, it is known to have the slide position influenced by sensed operating parameters of the compressor. Examples of such devices are disclosed in SE No. 427 063, SE No. 430 709, DD No. 127 878 and U.S. Pat. No. 3,936,239. The operating parameters sensed in the compressors disclosed in the above mentioned patent documents are either the electrical power consumption of the prime mover or the difference between the outlet pressure and the pressure in a compression chamber just before opening. In the first alternative the slide is adjusted to a position where the power consumption is at its minimum, which corresponds to a minimum of losses in efficiency due to under- or overcompression. In the second alternative the pressure in the compression chamber affects the slide to move in a direction of larger outlet area, whereas the pressure in the pressure channel affects the slide to move in the opposite direction, whereby the slide is adjusted to a position where these pressures balance each other.

Both these methods for governing the $V_i$-regulation, however, have serious deficiencies.

Using the power consumption as the governing parameter introduces a source of error in that fluctuations in the electricity supply network affects the sensed parameter. Furthermore, the power consumption as a function of the deviations of the end pressure in the compressor from the pressure in the pressure channel has a very flat characteristic, resulting in a poor accuracy; which allows the influence of said fluctuations to be relatively dominating. This method of governing therefore at the best might be able to keep the losses in efficiency at an acceptable level but will not be sufficient to handle the noise problem.

The method to use the pressure difference for governing the regulation has shown to be difficult to work in practice. The main reason for that is that sensing the end pressure in the compressor cannot be accomplished in a reliable way, since the sensed pressure fluctuates, and considerable pressure pulses are generated each time the means limiting a compression chamber passes the sensing point. It will therefore be practically impossible to use this way for reaching the balanced position where neither under- nor overcompression prevails.

SUMMARY OF THE INVENTION

The object of the present invention therefore is to find a better method for governing the adjustment of the built-in volume ratio.

This has according to the invention been achieved by providing a rotary displacement compressor of the introductionally specified kind with a connection channel having one end communicating with the pressure channel and a second end communicating with the working space in an area located adjacent the outlet port of the compressor, said sensing means being provided in the connection channel and being a flow direction indicating means for indicating the direction of flow in the connection channel, said actuating means being arranged to displace said edge in a direction towards a later moment of opening at an indicated flow in the connection channel from said one end to said second end and to displace said edge in a direction towards an earlier moment of opening at an indicated flow in the opposite direction.

Advantageous embodiments of the invention are specified in the subsequent dependent claims.

Through the connection channel the working medium or a mixture thereof and oil is allowed to flow from the working space to the pressure channel or conversely. The direction of flow is dependent on at which end of the channel the pressure is at the highest, the pressure considered being the integrated means pressure at the respective end. The end facing the pressure channel is exposed to a pressure which during a working cycle—corresponding to the time required for a compression chamber to move to the position of the compression chamber next ahead—can be regarded as constant, whereas at the end facing the working space the pressure will fluctuate during said period of time. This pressure will mainly range between the end pressure in a compression chamber and the pressure in the pressure channel, but during a short moment, when the means on a rotor limiting a compression chamber passes the end of the channel, a very powerful pressure pulse is generated. The pulse, however, lasts so short that it does not appreciably affect the mean pressure at this end and thus is not able to change the direction of flow through the connection channel.

Thanks to the use of the direction of flow through the connection channel as the governing parameter instead of the pressure difference it is attained a governing parameter that is not affected by the fluctuations in the pressure, which during a working cycle appear near the outlet. In particular this relates to the powerful pressure pulses which make the conventional regulation using pressure difference so problematic, since in that case the momentary pressure is the governing parameter.

Sensing the direction of flow gives a reliable and direct indication of if there is under- or overcompression and thus makes possible a more correct adjustment of the position of the movable outlet port edge than what can be done according to the known technique using the power consumption of the prime mover or the pressure difference for this adjustment. The invention thus makes it possible to more completely than before reduce noise and vibration caused by under- or overcompression.

The invention will be further explained in the following description of a preferred embodiment thereof and with reference to the accompanying drawings.

DETAILED DESCRIPTION OF THE DRAWINGS

Figure 1:
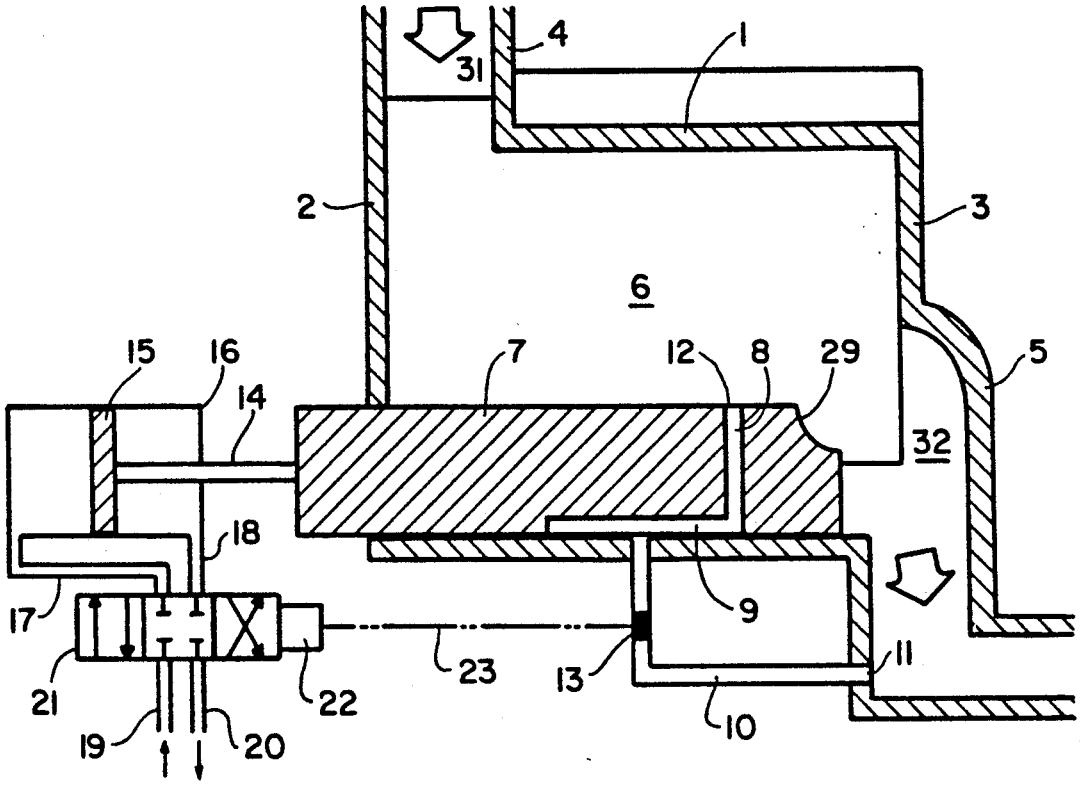
FIG. 1 schematically shows a transverse section through a rotary displacement compressor of the screw rotor type provided with a device according to the invention, details not pertinent to the invention being omitted.

The rotary screw compressor shown in FIG. 1 has two rotors (of which only one, 6 can be seen in the figure) provided with helical lobes and grooves through which the rotors intermesh. The rotors are contained in a working space limited by two end walls 2, 3, a fixed barrel wall 1 and a movable slide 7. The surface of the slide 7 facing the working space is of a shape in correspondence with the shape of the fixed barrel wall 1 so that the working space in a section perpendicular to the rotor axes is of the shape of two intersecting cylinders. Gas is sucked from a suction channel 4 through an inlet port 31 and is compressed in chevron-shaped compression chambers formed between the rotors 6 and the surrounding casing 1, 2, 3, 7 when they move axially from the suction channel 4 to a pressure channel 5, through which the compressed gas leaves the compressor. The slide 7 at its end adjacent the outlet port 32 has an edge 29, forming a part of the outlet port 32 and determining the moment at which a compression chamber opens towards the outlet and with that determining the volume ratio of the compressor. Optimal operating conditions are attained when the volume ratio matches the pressure in the pressure channel so that neither under- nor overcompression will occur. The position of the slide 7 and therewith the position of edge 29 is adjusted by means of a valve-governed hydraulic piston 15.

For adjusting the slide 7 the compressor is provided with a device sensing deviations from the optimal position. This device includes a connection channel 8, 9, 10, connecting the working space to the pressure channel 5. The connection channel is formed by a boring 8 through the slide, an axial groove 9 in the slide 7 opposite the side facing the working space and a pipe 10 connecting the groove 9 to the pressure channel 5. The end 12 of the connection channel facing the working space is located at a short distance from the edge 29 of the slide 7, determining the moment of opening, about 0.25 to 1, preferably 0.5 lobe pitch from said edge. When the end 12 is located within this area it will communicate with the working space in a compression chamber, which during one phase of its axial travelling towards the outlet port 32 is closed and has a volume decreasing to its minimum and which during a second phase, when the forerunning lobe tip of the compression chamber has passed the edge 29 of the outlet port 32 is open towards the outlet port displacing the gas out through the same. The pressure at this end 12 will thereby fluctuate mainly between the end pressure in the compressor and the pressure in the pressure channel, resulting in a mean pressure within this range. There will also be a powerful pressure pulse at the end 12 of the connection channel each time a lobe tip passes the same. The connection channel 8, 9, 10 will be filled with a mixture of gas and oil from the oil layer created between the outer periphery of the rotors and the surrounding wall. Through the channel 8, 9, 10 the oil, containing gas bubbles can flow from the working space to the pressure channel 5 or in the opposite direction, depending on whether the mean pressure at the end 12 facing the working space is higher or lower than the pressure at the end 11 facing the pressure channel 5.

In the pipe 10 there are means for sensing the direction of flow through the same. If the end pressure in the compressor is lower than the pressure in the pressure channel 5, i.e. at undercompression, the mean pressure at the end 12 of the connection channel 8, 9, 10 facing the working space will be lower than the pressure at the end 11 of the connection channel 8, 9, 10 facing the pressure channel 5. The pressure difference causes the oil-gas mixture to flow through the connection channel 8, 9, 10 from the pressure channel 5 to the working space, which will be sensed by the sensing means 13.

Figure 2:
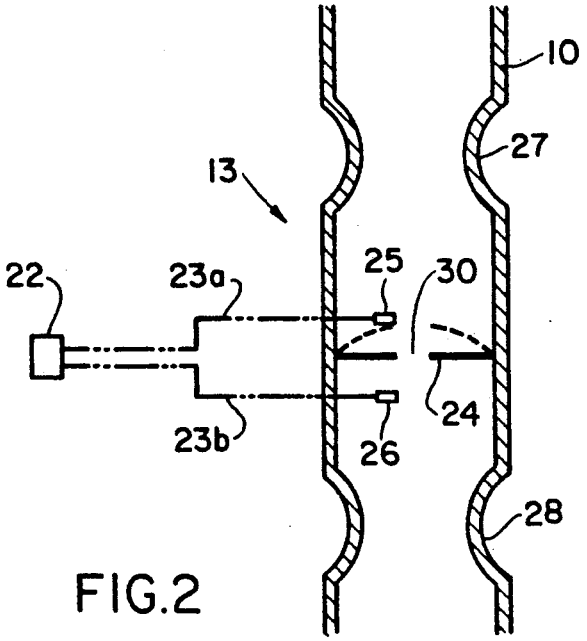
FIG. 2 shows a detail of FIG. 1.

In FIG. 2 an advantageous embodiment of the sensing means is shown. Between two restrictions 27, 28 the pipe 10 a membrane 24 provided with a central hole 30, allowing passage of the oil-gas mixture, is fastened. When the oil-gas mixture in the pipe 10 is stagnant the membrane 24 will take a neutral position, shown by unbroken lines in the figure. If instead the mixture is flowing through the pipe, the membrane will bulge in either direction, depending on the direction of flow. It is indicated by broken lines how the membrane 24 will be positioned when the flow is directed upwards in the figure, representing a flow from the pressure channel 5 to the working space. A short distance from the membrane on each side thereof there is a contact device 25, 26. In the bulged position the membrane 24 is touching one of these contact devices 25, 26. In the position indicated by broken lines in the figure it touches the contact device 25, whereby an electrical circuit is closed which activates a driving device 22, e.g. a magnetic relay, of a valve 21 (see FIG. 1).

In FIG. 1 the valve 21 is shown in a neutral position corresponding to the neutral position of the membrane 24 in FIG. 2, in which the position of the slide 7 is not affected. When the driving device 22 is activated by the signal from the contact device 25 it forces the valve 21 to move rightwards in the figure, allowing pressure oil from a pipe 19 connected to a pressure oil source to flow through pipe 17 to the left end of the hydraulic cylinder 16 simultaneously as oil is allowed to escape from the right end of the hydraulic cylinder 16 through the pipe 18 to a drainage pipe 20. Thereby the piston 15 will move rightwards in the figure, and by means of the piston rod 14 also the slide 7 will move. Thereby its edge 29 is moved to a position where the moment of communication between a compression chamber and the pressure channel 5 occurs later. When the edge 29 in this way is displaced, the volume ratio of the compressor will increase so that its end pressure increases, resulting in an increased mean pressure at the end 12 of the connection channel 8, 9, 10 facing the working space. After a certain movement of the slide 7, the mean pressure pressure at the end 12 has approached the pressure in the pressure channel 5 enough for the flow through the connection channel 8, 9, 10 to decrease so that it no longer is able to keep the membrane 24 in touch with the contact device 25. In that moment the signal to the driving device 22 of the valve 21 is broken, whereby the valve 21 returns to the neutral position and the adjusting movement of the slide 7 ceases. The compressor now will operate at a volume ratio mainly complying with the pressure in the pressure channel 5.

If the sensing means 13 indicates a flow in the opposite direction, i.e. from the working space to the pressure channel 5, there is overcompression. In this case a signal is transmitted to the valve 21 to accomplish a movement of the slide 7 in the leftwards direction in FIG. 1, which is done in a corresponding way as described above for undercompression.

It is not necessary that the regulating device is continuously active. It is sufficient to activate it in regular intervals, e.g. each ten minutes.

In the described example it was said that the adjusting movement will be stopped when the membrane 24 comes out of touch with the contact device 25, which will occur shortly before the flow through the connection channel 8, 9, 10 has gone down to zero. As an alternative it is possible to arrange the signal circuit 23 in such a way that the adjusting movement will not be stopped until the membrane 24 has passed its neutral position and is touching the other contact device 26. At that moment the flow through the connection channel 8, 9, 10 has not only reached zero but also has changed its direction. In this case a certain overcompensation in the adjustment of the slide 7 is attained, whereas in the earlier described case there was a certain undercompensation. The sensing means 13, however, can be so precisely dimensioned that the influence of this over- or undercompensation will be negligible. The regulation accuracy will in all cases be considerably improved in comparence with earlier applied technique. The remaining noise source due to the fact that the pressure in the compressor and the pressure in the pressure channel 5 are not completely equalized will also be damped by the open connection between the working space and the pressure channel 5 through the connection channel 8, 9, 10.

It is to be noted that the construction of the flow direction indicating means not necessarily is limited to the one described above. It can for example be constituted by a body having a section corresponding to the shape of the connection channel and being provided with a through hole, which body is free to move between two abutments acting as contact devices. Or it can be in the form of a disc, pivotable between contact devices. Furthermore, the adjustment of the $V_i$-regulating means can as well be accomplished mechanically or electrically instead of hydraulically.

Figure 3:
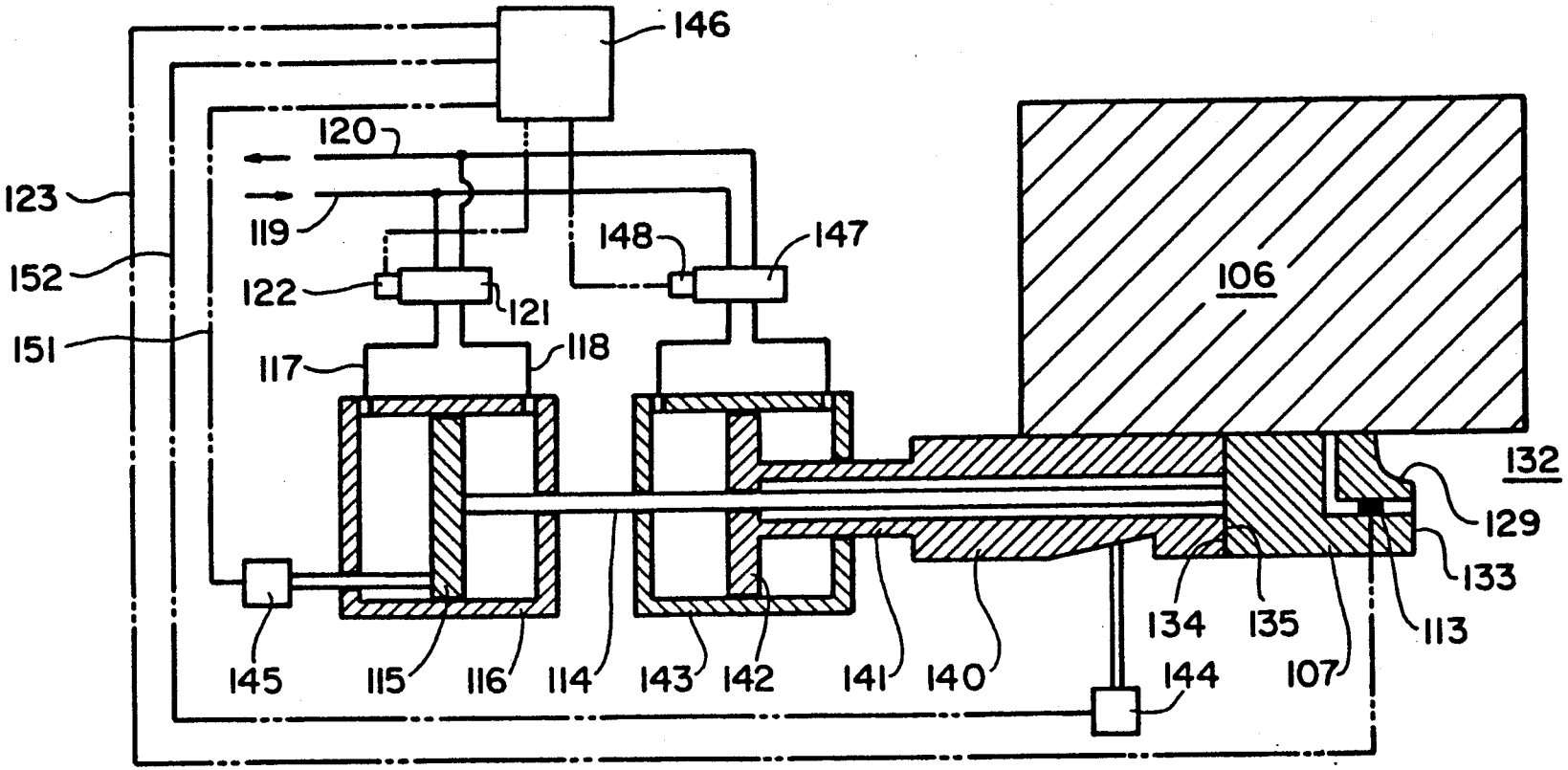
FIG. 3 schematically shows a second embodiment of the invention.
Figure 4:
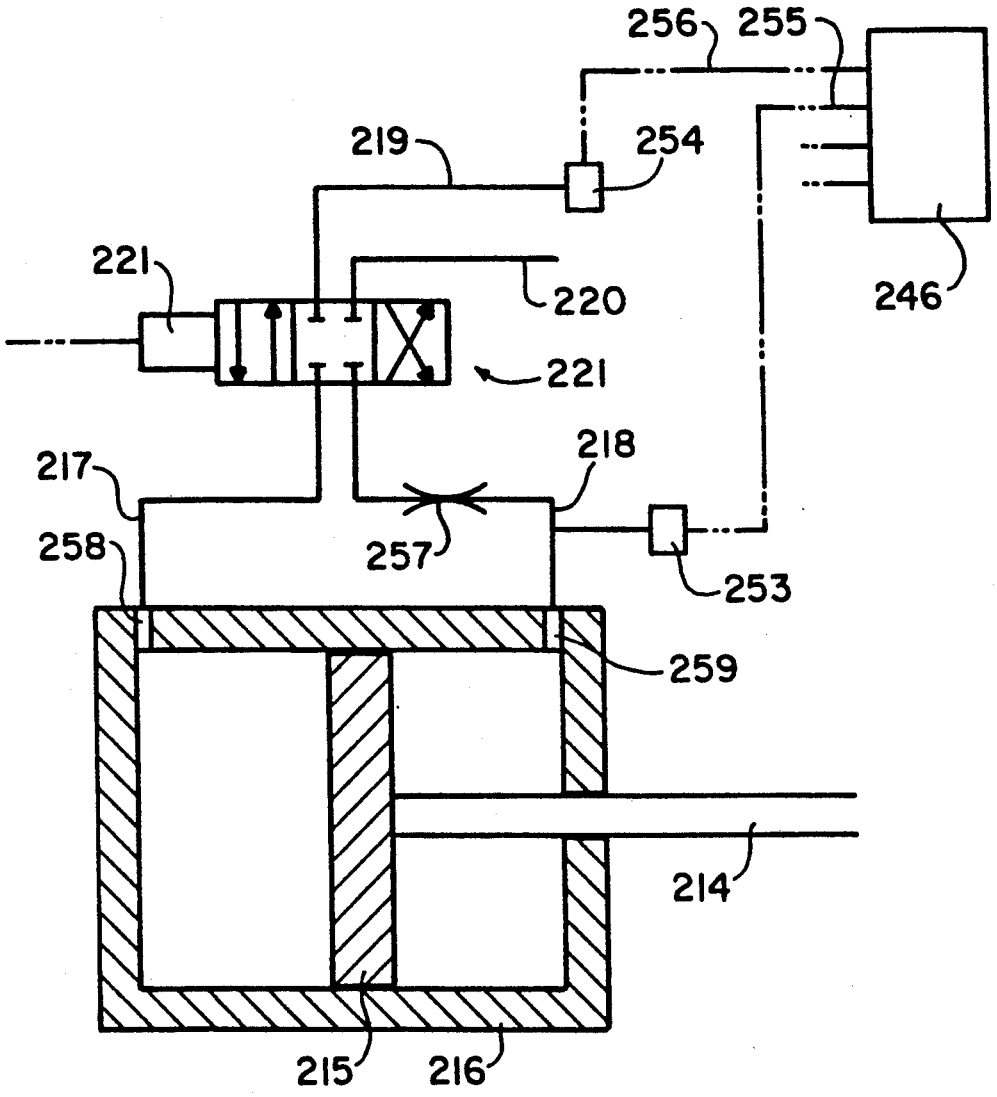
FIG. 4 shows a detail of a third embodiment of the invention.

The invention can be advantageously applied to a compressor of the rotary screw type having means for also varying the capacity, e.g. by a movable slide stop member. In such cases the sensing means has to include means for sensing further parameters than the flow direction through the connection channel due to the combined effect on the capacity and the volume ratio of the regulating slide and the slide stop member and due to the necessity to avoid interference between these two elements. FIGS. 3 and 4 illustrates two different embodiments of the invention when applied to a rotary screw compressor in which both the $V_i$ and the capacity can be varied.

According to the embodiment shown in FIG. 3 the sensing means also include means for sensing the axial positions of the regulating slide and the slide stop member, in a way similar to that disclosed in U.S. Pat. No. 4,516,914, which hereby is incorporated by reference.

In addition to the regulating slide 107 the compressor of FIG. 3 is provided with a slide stop member 140. Both the elements 107 and 140 are displaceable mounted in a recess communicating with the working space and the inlet port. Like the regulating slide 107 the slide stop member 140 has a surface facing the working space, which surface is of a shape corresponding to the shape of the barrel wall and is in sealing relationship with the rotors 106. Displacement of the regulating slide 107 is accomplished through the rod 114 connected to the piston 115 in the cylinder 116. Supply and withdrawal of oil to and from the cylinder 116 through the connection pipes 117 and 118 are controlled by the solenoid valve means 121 selectively connecting them to supply and vent pipes 119 and 120 in a manner described more in detail in connection with FIG. 1.

The slide stop member 140 is by a sleeve 141 connected to a piston 142 in a cylinder 143. Displacement of the piston 142 in the cylinder 143 thus results in a change in the position of the slide stop member 140. Solenoid valve means 147 controls the supply and withdrawal of the hydraulic oil to and from the cylinder 143.

When the regulating slide 107 and the slide stop member 140 are in contact with each other they form a continuous composite member and the compressor is running at full capacity, at which the volume ratio is determined by the position of the composite member. Reduced capacity is attained when the regulating slide 107 and the slide stop member are separated from each other, as communication then is opened between the working space and the inlet port through the recess, mounting the regulating slide 107 and the slide stop member 140. In this mode the position of the regulating slide 107 affects both the capacity and the $V_i$.

In addition to the flow direction indicating means 113 the sensing means comprise first means 145 for sensing the axial position of the regulating valve 107 and second means 144 for sensing the axial position of the slide stop member 140. Signals from the flow direction indicating means 113 and the first and second position sensing means 145, 144 are transmitted by wires 123, 151, 152, respectively, to a signal processing unit 146. From this, output signals affect the solenoides 122 and 148 of the valve means 121 and 147 to actuate the pistons 115 and 142 for adjusting the regulating slide 107 and the slide stop member 140 to positions corresponding to the required capacity and $V_i$, and for assuring that they do not interfere with each other.

The embodiment of the invention illustrated in FIG. 4 differs from the one of FIG. 3 in that the means sensing the axial position of the regulating slide are replaced by means sensing the pressure in the oil supply source and at a point in the oil pipe connections of the cylinder actuating the regulating valve whereas all other elements are principally the same as in FIG. 3. It is therefore supposed to be sufficient to describe the embodiment of FIG. 4 only in respect of the distinguishing features.

The piston 215 within the cylinder actuates the regulating slide through the rod 214. Oil is supplied to the cylinder 216 from the oil supply pipe 219 and is withdrawn therefrom through the oil vent pipe 220. The supply and withdrawal is controlled by solenoid valve means 221 connected to the cylinder 216 through connection pipes 217 and 218. When the valve means 221 are in a position opening communication between the oil supply pipe 219 and the connection pipe 218 and openings 258 and 259, respectively, which ends in the right end of the cylinder 216 as viewed in the figure, the actuating force therefrom tends to displace the regulating slide to the left to an earlier occurence of the opening of the outlet port.

The connection pipe 218 has a restriction 257 and between this restriction 257 and the cylinder 216 there are provided pressure sensing means 253 for sensing the static pressure, $p_2$ in the pipe 218. Similar pressure sensing means 254 are provided in the oil supply source for sensing the pressure, $p_1$ therein. Signals from the pressure sensing means 253 and 254 are transmitted by wires 255 and 256 to the signal processing unit 246, which thus receives information about the pressure difference between $p_1$ and $p_2$. The signal processing unit 246 answers to the signals from the pressure sensing means 253 and 254 by activating the solenoid valve means 221 to positions where oil is supplied to the right end of cylinder 216 when $p_1 > p_2$ and to the left end of cylinder 216 when $p_2 > p_1$.

If the system calls for more capacity and there is an opening between the regulating slide and the slide stop member, the valve means 221 will be actuated to a position, in which oil is directed to the right end of the cylinder through the connection pipe 218. As long as oil flows from the supply pipe 219 through the connection pipe 218, $p_1$ will exceed $p_2$ due to the restriction 257 in the connection pipe 218, and as long as the signal processing unit 246 receives signals indicating this pressure difference the stroke will continue. When the piston 215 has moved so far to the left that the regulating slide hits the slide stop member and thus closes the opening between these two elements, the piston 215 cannot move any further. As a consequence the flow through the connection pipe 218 ceases and the pressure difference over the restriction 257 is equalized, whereby the solenoid valve means 221 returns to its neutral position, hydraulically locking the piston 215.

If the system calls for a higher $V_i$ and more capacity and there is no opening between the regulating slide and the slide stop member, displacement of the slide stop member towards a higher capacity position, i.e. rightwards exerts a force on the regulating slide to move in the same direction by the contact between these elements. A rightward movement of the piston 215 in cylinder 216 raises the pressure $p_2$ until it exceeds the supply pressure $p_1$, resulting in that the solenoid valve means 221 are actuated to a position where the supply pipe 219 is brought into communication to the left end of the cylinder 216 through the connection pipe 217 and the vent pipe 220 is brought into communication with the right end of the cylinder 216 through the connection pipe 218. With the valve means 221 in this position the regulating slide thus is actuated to move uniformly with the slide stop member. This will continue until the slide stop member has reached the new position corresponding to the required capacity. When the slide stop member now no longer exerts a force on the piston 215 in the rightwards direction the pressure $p_2$ will immediately drop to the pressure $p_1$ in the supply source, whereby the valve means 221 will return to the neutral position and the movement ceases.

By the above described arrangement sensing the pressures $p_1$ and $p_2$ it is thus attained that the regulating slide will adapt its position to the slide stop member, whereas in the embodiment according to FIG. 3 this was accomplished by mechanically sensing the axial positions of both these elements.

We claim:

1. A rotary displacement compressor having at least one rotor (6) mounted in a working space formed by a casing (1, 2, 3, 7) surrounding the rotor(s) (6), in which working space a gaseous working fluid is transported and compressed in compression chambers from an inlet port (31) connected to a suction channel (4) to an outlet port (32) connected to a pressure channel (5), said outlet port having an edge (29) determining the moment of opening for a compression chamber towards the outlet port (32), the position of said edge (29) being adjustable by actuating means (15, 16) governed by sensing means (13), characterized in that the compressor is provided with a connection channel (8, 9, 10) having one end (11) in communication with the pressure channel (5) and a second end (12) in communication with the working space in an area adjacent the outlet port (32) of the compressor, said sensing means (13) including a flow direction indicating means (13) in the connection channel (8, 9, 10) for indicating the direction of flow in the connection channel (8, 9, 10), said actuating means (15, 16) being arranged to displace said edge (29) in a direction towards a later occurrence of said moment of opening when sensing a direction of flow in the connection channel (8, 9, 10) from said one end (11) to said second end (12) and to displace said edge (29) in a direction towards an earlier occurrence of said moment of opening when sensing a flow in the opposite direction.

2. A compressor according to claim 1, in which said rotor(s) (6) is/are of the screw rotor type.

3. A compressor according to claim 2, in which the number of rotors (6) is two, which rotors (6) intermesh through helical grooves and lobes on the rotors (6), thereby forming chevron-shaped compression chambers.

4. A compressor according to claim 3 having a regulating slide (7; 107), axially displaceable in a recess in the casing, said recess being parallel to the rotor axes and in open communication with said working space, said regulating slide (7; 107) having front (33; 133) and rear (34; 134) ends and a surface facing the rotors in sealing relationship therewith, said front end (33; 133) facing the outlet port (32; 132) and forming said edge (29; 129).

5. A compressor according to claim 4, in which said connection channel (8, 9, 10) at least partly is arranged in said regulating slide (7).

6. A compressor according to any of claims 3 to 5, in which said area is located at a distance 0.25 to 1, preferably 0.5, lobe pitch from the edge (29) determining the moment of opening.

7. A compressor according to any of claims 4 to 5 having a slide stop member (140) displaceable in said recess, said slide stop member having a front end (135) and a surface facing the rotors (106) in sealing relationship therewith, said front end (135) being adapted to engage said rear end (134) of the regulating slide (107) to form a continuous composite member, said regulating slide (107) and said slide stop member (140) being movable apart to provide an opening therebetween of variable selected size and position in connection with the inlet port.

8. A compressor according to claim 7, in which said sensing means further include means (145) for sensing the axial position of said regulating slide (107) and means (144) for sensing the axial position of said slide stop member (140).

9. A compressor according to claim 7, in which displacement of said regulating slide is effectuated by hydraulic means including a piston (215) connected to the regulating slide, said piston (215) being displaceable in a cylinder (216) having a first opening (259) in one end thereof and a second opening (258) in the other end thereof, first (218) and second (217) connection pipes connecting said first (259) and second (258) openings to valve means (221), oil supply (219) and vent (220) pipes connected to said valve means (221) for selectively adjustable connection with said first (259) and second (258) connection pipes so as to displace the regulating slide towards a position of earlier occurrence of said moment of opening when said oil supply pipe (219) is connected to said first opening (259), said first pipe (218) having a restriction (257), said sensing means further include means (254) for sensing the static pressure in the source of said oil supply pipe (219), means (253) for sensing the static pressure in said first pipe (218) in an area between said restriction (257) and said first opening and means for sensing the axial position of said slide stop member.

* * * * *

UNITED STATES PATENT AND TRADEMARK OFFICE

CERTIFICATE OF CORRECTION

PATENT NO. : 5,018,948

DATED : May 28, 1991

INVENTOR(S) : SJÖHOLM et al

It is certified that error appears in the above-identified patent and that said Letters Patent is hereby corrected as shown below:

Title page, in Section [19] and Section [75], change the spelling of the first inventor to:

--Lars Sjöholm--.

Signed and Sealed this

Twenty-ninth Day of December, 1992

*Attest:*

DOUGLAS B. COMER

*Attesting Officer*

*Acting Commissioner of Patents and Trademarks*